US005320499A

United States Patent [19]

Hamey et al.

[11] Patent Number: 5,320,499

[45] Date of Patent: Jun. 14, 1994

[54] OPEN-LOOP HYDRAULIC SUPPLY SYSTEM

[75] Inventors: Peter M. Hamey, Emsworth; John Ineson, Bedhampton, both of England

[73] Assignee: Vickers Systems Limited, Hampshire, England

[21] Appl. No.: 943,303

[22] Filed: Sep. 10, 1992

[30] Foreign Application Priority Data

Sep. 12, 1991 [GB] United Kingdom ..... 9119448

[51] Int. Cl.[5] ..... F04B 1/26

[52] U.S. Cl. ..... 417/218; 417/222.1; 60/431; 60/449

[58] Field of Search ..... 60/449, 431; 417/218, 417/222.1

[56] References Cited

U.S. PATENT DOCUMENTS 4,158,290 6/1979 Cornell ..... 60/449

4,559,778 12/1985 Krushe ..... 60/449

5,064,351 11/1991 Hamey et al. ..... 417/222.1

*Primary Examiner*—Richard A. Bertsch

*Assistant Examiner*—Peter Korytnyk

*Attorney, Agent, or Firm*—Barnes, Kisselle, Raisch, Choate, Whittemore & Hulbert

[57] ABSTRACT

A system comprising a secondary mover such as an hydraulic pump driven by a prime mover such as a motor powered, in use, by an alternating current (AC) electrical supply, whereby the operation of the secondary mover is affected by any frequency variation in a substantially constant voltage AC supply. The system further comprises adjustment means in use powered by the same AC supply as the prime mover, having inherently substantially the same operating characteristics as the prime mover, being coupled to the secondary mover and operable to adjust the operating range thereof in accordance with variations in the frequency of the AC supply.

24 Claims, 9 Drawing Sheets

TORQUE/DISPLACEMENT RELATIONSHIP APPLICABLE TO A GIVEN PUMP OPERATED AT VARIOUS SPEEDS

AC ELECTRIC MOTOR DRIVEN HYDRAULIC PUMP

CONSTANT FREQ. AC SUPPLY
REQUIREMENT TO MATCH MOTOR OUTPUT TORQUE TO PUMP INPUT TORQUE NEEDS

VARIABLE DISPLACEMENT HYDRAULIC PUMP

Q/P CHARACTERISTICS OF VARIABLE DISPLACEMENT PUMP DRIVEN AT DIFFERENT SPEEDS

RELATIONSHIP OF PUMP & MOTOR CHARACTERISTICS OVER A FREQUENCY RANGE FOR CONSTANT VOLTAGE AC SUPPLY

AS FIG.13 EXCEPT DECREASING FREQUENCY CAUSES CORE 82 TO MOVE TO THE LEFT & TO THE RIGHT FOR INCREASING FREQUENCY

CONTROL AS FOR FIG. 14 & 16 EXCEPT INCREASE IN FREQUENCY INCREASES $P_{C2}$ AND A DECREASE IN FREQUENCY DECREASES $P_{C2}$

OPEN-LOOP HYDRAULIC SUPPLY SYSTEM

BACKGROUND

The invention relates to systems for controlling the operation of a secondary mover, which is driven by a prime mover. The invention is particularly useful in applications wherein the prime mover is "wild", that is to say, no control action may be applied to the prime mover.

One application for the present invention arises in aircraft, wherein hydraulic power is used to move the control ailerons. In most types of aircraft, it is a requirement that an emergency source of hydraulic power be provided which can be used in the event of a failure of the main hydraulic power system. To this end, it is known to employ a prime mover, such as a ram air turbine, for a variable displacement hydraulic pump, the prime mover powering the hydraulic pump in order to provide emergency hydraulic power for the control ailerons, etc. However, since the operation of the prime mover is dependent upon the airspeed of the aircraft, then as the aircraft loses airspeed in an emergency situation, the prime mover loses power and the alternative hydraulic power supply can be lost at a relatively early stage because with a variable displacement pump, a pressure compensator is normally provided which ensures that the pump delivers hydraulic fluid at the flow rate demanded by the system and at a predetermined pressure. Accordingly, if the outlet pressure of the pump falls due to decreasing airspeed, then the pump will automatically try to increase that pressure by increasing the stroke of the pump, resulting in increased pump demanded power leading to stalling of the prime mover. Clearly, this is not acceptable with an emergency hydraulic supply and it is an object of the present invention to provide apparatus which obviates this problem.

Often, in such aircraft, applications, wild AC generators, which are driven by the aircraft engine(s), are provided to power an electric motor pump. It will be appreciated that any variation in engine speed will alter the frequency of the substantially constant AC supply voltage used to energise the motor and hence affect the maximum output power of the system. By way of background, this problem is discussed in general terms below.

A common requirement for a hydraulic pump, such as a variable delivery swash pump, is that the output pressure should be held substantially constant regardless of the flow rate, which may vary widely depending on the load. A swash pump can be converted to a pump of this (constant pressure) type by providing a feed back path by means of which the swash plate or yoke angle is made dependent on the output pressure. This is normally achieved by providing a pressure compensator valve which balances the pump output pressure against a spring. The output from the valve is fed to a piston which controls the angle of the swash plate or yoke. Thus if, for example, the pump output pressure rises, because of the load, the spool of the compensator valve is moved against its spring, providing a path for the high pressure fluid from the pump output to reach the valve output and so move the yoke angle control piston against a yoke restoring spring. This decreases the angle of the swash plate or yoke, so decreasing the flow rate-.

This will decrease the pressure to match the new load condition.

Conversely if the pump output pressure falls, because of increased demand, the spool of the compensator is moved by its spring, releasing pressure from the piston allowing the yoke restoring spring to increase the angle of the swash plate or yoke, so increasing the flow rate. This will result in a rise of pressure to match the new load. Provided these load/demand changes are within the capacity of the pump the negative feedback operating will hold the output pressure steady by increasing flow rate on any drop of pressure.

Once the maximum possible yoke angle is reached and the maximum flow rate is achieved, the output pressure will no longer be held constant for any further flow demand but will fall, while the flow rate will remain constant.

It is useful to note also that in the constant pressure region of operation, the torque required to drive the pump and the power are both proportional to the flow rate. The input power is the product of torque/speed and the output power is the product of pressure/flow rate, these are of course equal if a pump efficiency of 100% is assumed.

It has been an implicit assumption so far that the speed at which the pump is driven is constant. The pump requires, of course, a suitable motor to drive it, and an AC electric induction motor is often used for this purpose. The speed of such a motor is not constant. In fact, the torque/speed characteristic of such a motor, driven from a substantially constant voltage supply is such that the speed matches the AC drive frequency for zero load torque, and falls as the torque increases. However, the change of speed is designed to be relatively small for a wide range of torques, and constant speed can therefore be assumed without substantial error. See FIG. 1 of the accompanying drawings.

This relationship only holds good if the torque demanded of the motor is within the torque range of the motor obtainable at sensibly constant speed. Torque demand above this level will enter a region of the motor characteristic exhibiting large changes of speed for small changes of torque. In this region the motor operation is unstable and tends to stall. See FIG. 1 again, In designing a motor driven pump it is obviously desirable to match the power output requirements of the AG motor to the input power requirements of the pump. For a constant speed application the critical parameter for the motor will be output torque (power being the product of torque and speed) and for the pump, input torque. The pump torque requirement is given by the product of pump displacement and pressure. For a pump operating at a constant pressure the maximum torque requirement occurs at the maximum displacement of the pump.

The input torque characteristics of the pump, over the full range of displacement, is shown in FIG. 2. As the torque is a function of pump displacement and system pressure, for a constant pressure system the characteristic holds good (except for churning losses) over a range of speed. The motor torque output characteristic (see FIG. 1) therefore has to meet, with some margin, the pump input torque requirement (see FIG. 2). This then sizes the motor needed to drive the pump (see FIG. 3). It is however possible, should the hydraulic requirements permit, to reduce the size of the drive motor by the introduction of a soft cut-off pressure compensator control giving the characteristic shown at 4A in FIG. 4 which has a reduced torque demand shown in FIG. 5, optimising both the hydraulic supply and the electrical loading.

This discussion is based on the assumption that the AC supply to the motor is of constant voltage and frequency. If, however, the AC frequency is variable, as in practice it may be, then the motor speed and torque will vary correspondingly (to an acceptable degree of approximation). While the pump outlet pressure will be maintained constant, independent of any speed change, by the pressure feedback control the pump output flow will vary correspondingly with speed provided the motor has sufficient drive torque.

Consider now the effects on the power output of the motor and the relationship to the pump requirements of a constant voltage variable AC supply frequency. It is characteristic of AG induction motors that the speed of the motor is proportional to the supply frequency while the output torque varies inversely with frequency (see FIG. 6) giving essentially constant output power over the frequency range. The effect on the pump being driven at variable speed is to vary the input power requirement. For any given displacement and system pressure the torque required to drive the pump is sensibly the same over a range of speeds (see FIG. 7) therefore as the speed increases the input power requirement increases proportionately with speed.

Torque T = Displacement × Pressure + Losses

Therefore, the torque required to drive a given pump at maximum displacement is proportional to pressure and independent of speed, neglecting losses, which while being speed dependent, are small.

It can be seen that a motor pump combination designed to provide a specified flow and system pressure, having a motor with adequate torque to drive the pump at full displacement at the minimum AC supply frequency will, as the AC supply frequency increases, rapidly enter the stall region of the motor characteristic (see FIG. 8).

Since the motor output torque is lowest at the maximum AC supply frequency, one solution would be to size the motor to provide adequate torque at the highest AC supply frequency. This would mean that the hydraulic supply would be grossly in excess of the specified system requirements at the high frequencies and the motor grossly oversized at the low frequencies. Returning, by way of example, to the aircraft hydraulic supply application since Ac supply frequency is tied to engine speed and the high frequencies are only likely to occur during take-off, the maximum power phase of a flight, the penalties of sizing the motor at the high frequencies, namely increased size, weight, cost, electrical power consumption and inefficient hydraulic power generation, are features to be avoided for the major part of a flight regime.

An ideal solution that addresses these penalties would be to limit the pump power requirements as a function of the AC supply frequency or motor speed such that pump input power needs to match the available motor power over the entire frequency range. Since the pump and motor Speeds are the same being mechanically coupled and power is the product of torque and speed, it is necessary to have matched torques if operating in a constant pressure system. This can be achieved by limiting the displacement of the pump as a function of AC supply frequency or unit speed for the required frequency range.

For a system not requiring constant pressure, other control methods may be employed such as a soft cut-off control characteristic indicated at 3A in FIG. 3, and in FIG. 4 where input torque requirements can be limited by a combination of displacement and pressure control associated with AC supply frequency.

SUMMARY OF THE INVENTION

The present invention stems from the concept of using adjustment means for the secondary mover which is driven from a substantially constant voltage, variable frequency AC source derived from or common to the prime mover, this concept linking the following aspects of the present invention.

According to one aspect, the invention provides an open-loop control apparatus for controlling the range of operation of a secondary mover driven by a prime mover, characterised in that the control apparatus comprises AC electromagnetic adjustment means operable to adjust the operating range of the secondary mover, and drive means operable to drive the adjustment means with an AC signal the frequency of which is proportional to the speed of the prime mover.

The electromagnetic adjustment means may be a proportional solenoid or force motor, for example, and the drive means may be a permanent magnet generator (PMG) the frequency of the AC output signal of which will vary according to the speed of the prime mover. The PMG may be associated with either the prime mover or the secondary mover because the latter will reflect any change in speed of the former. The prime mover may be of any type other than an AC motor, otherwise the supply to the AC motor can be used to drive the adjustment means direct according to a second aspect of the invention. The prime mover may be a ram air turbine and the secondary mover may be an hydraulic pump.

According to a second aspect, the present invention provides an open-loop control system for controlling the range of operation of a secondary mover driven by a prime mover powered, in use, by an alternating current (AC), substantially constant voltage, electrical supply, whereby the operation of the secondary mover is affected by any frequency variation in the AC supply, characterised in that the system comprises adjustment means in use powered by the same AC supply as the prime mover, having an inherently substantially similar operating characteristic as the prime mover, and being coupled to the secondary mover and operable to adjust the operating range thereof in accordance with variations in the frequency of the AC supply. This maintains the output power of the secondary mover close to the maximum available power of the prime mover.

According to a third aspect, the present invention provides an open-loop system for controlling the range of operation of a variable displacement hydraulic pump driven by electric motor in use powered by an alternating current (AC) constant voltage electrical supply, whereby the operation of the pump is affected by any frequency variation in the AC supply, characterised in that the system comprises adjustment means powered by the same AC supply as the electric motor, having an inherently substantially similar operating characteristic as the motor, and being coupled to the pump and operable to adjust the operating range thereof in accordance with variations in the frequency of the AC supply.

This maintains the output power of the pump close to the maximum available power of the motor. The maximum available flow from a pump controlled in this way is essentially constant i.e. independent of frequency and speed.

The inherently substantial similar characteristic of the prime mover and the adjustment means may be that of the torque or force output of the adjustment means and the prime mover being similarly entirely proportional to the AC supply frequency. Therefore, when the adjustment means is connected to the secondary mover it will adjust the secondary mover power demand to match the output of the prime mover in accordance with the supplied AG frequency, whereby the secondary mover never demands more power than the prime mover is able to supply.

Preferably, the adjustment means are electromagnetic and in one embodiment concerning the control of a swash pump the adjustment means comprise first cylinder means in which the piston of the conventional swash plate or yoke actuator is mounted for limited sliding movement, the extent of which movement determines the operating range of the pump, the first cylinder means being slidably mounted, in the manner of a piston, in a second and fixed cylinder of the actuator, and electromagnetic drive means coupled to the first cylinder means and energised, in use, by said AC supply, whereby the first cylinder means is positioned within the second cylinder means in accordance with any variation in the frequency of the AC supply so as to vary the range of operation of the pump.

The electromagnetic means which may be employed in the adjustment means may be a solenoid or a force motor, both of which are linear motion devices, or an electric motor the output of which would require converting from rotary motion to linear motion.

Provided that the piston is not in engagement with the first cylinder means, the operation of the actuator is conventional because the position of the piston is not affected by the position of the first cylinder means. In particular, one extreme position of the piston will, as before, hold the yoke or swash plate at right angles to its shaft, and give zero flow rate. However, the travel of the piston from that extreme position will be liable to limitation according to the position of the first cylinder means; the further the first cylinder means has been moved towards the zero flow rate position of the piston, the less the travel of the piston will be from that position and hence the lower the maximum flow rate. Thus what is normally a fixed operating range is made a controlled or variable operating range, which range is decreased in the presence of increases in the frequency of the constant voltage AC supply.

Conveniently, the position of the first cylinder means is controlled by a limit control pressure P1, produced by a limit spool valve assembly, which is driven by a solenoid. The solenoid is energised with the same AC constant drive voltage as is used to energise the prime mover in the form of a motor, the solenoid having inherently substantially the operating characteristics as the motor in that the force it exerts on its core is inversely dependent on the frequency of the drive supply. A change of frequency therefore causes the position of the first cylinder means to change, thus changing the limit of the travel of the piston controlling the yoke angle. The maximum flow rate of the pump is thus limited in dependence on the motor drive voltage frequency.

It will be realised, of course, that the limit on the yoke or swash plate angle may be controlled by a mechanism which is essentially separate from the yoke actuator mechanism, The input torque requirement of a pump is dependent on the displacement and operating pressure, whereby either could be modified to match the torque output of the prime mover. In one embodiment of the present invention, an hydraulic system requires flow to be maintained at the expense of pressure and the conventional pressure compensator employed with the pump may be modified such that its pressure setting controlled by the frequency of the AG supply that powers the prime mover or an AC signal the frequency of which is proportional to the speed of the prime mover. The modified pressure compensator may comprise a modulation means which is hydraulically operated under the control of the adjustment means.

The present invention thus varies the operating range of the secondary mover so that the prime mover can be operated at maximum power output irrespective of variation in the speed of the prime mover, whereby a smaller capacity prime mover can be employed than is currently the case. As explained, an oversize prime mover has to be used to cover all eventualities even though the full capacity is not required in normal operation. The present invention, however, provides an additional advantage, beyond that of allowing a smaller capacity motor to be used. With a conventional pump system, the yoke or swash plate angle (or displacement of the pistons in the block) is at its maximum value when the pump is being started. Hence on starting, when the prime mover speed is low, the torque demand is high. With the present system, on start-up there is zero adjustment force, and hence the flow rate is limited to a very low value. The strain on the system (and in particular on the motor) during start-up is therefore considerably reduced. This advantage flows even when the secondary mover is not a hydraulic pump. For example, the secondary mover may be a fan having variable pitch blades adjustable by the adjustment means, or a variable ratio gearbox where, for the advantage under discussion, the gearbox would be at its highest (reduction) ratio for start up.

BRIEF DESCRIPTION OF THE DRAWINGS

FIGS. 1 to 8 are explanatory diagrams already referred to;

DETAILED DESCRIPTION OF THE DRAWINGS

Figure 9:
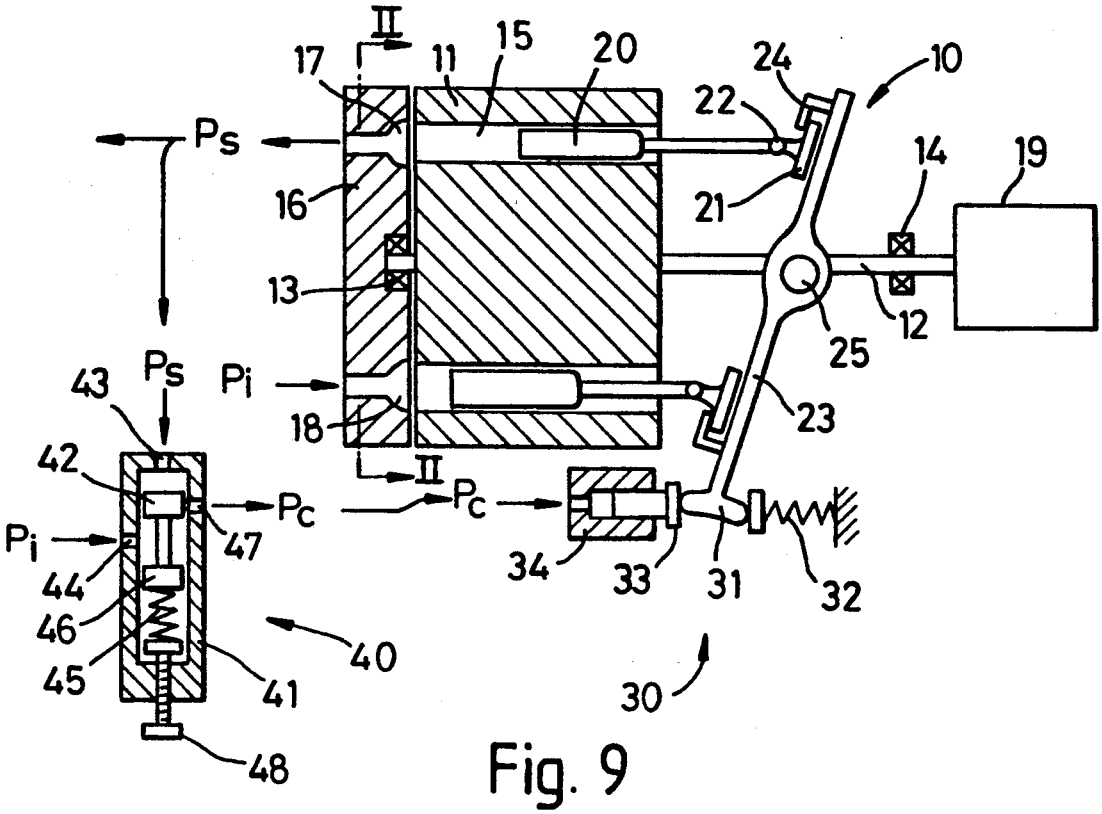
Fig. 9 PRIOR ART
FIG. 9 is a simplified diagrammatic view, mainly in section, of a known pump system.
Figure 10:
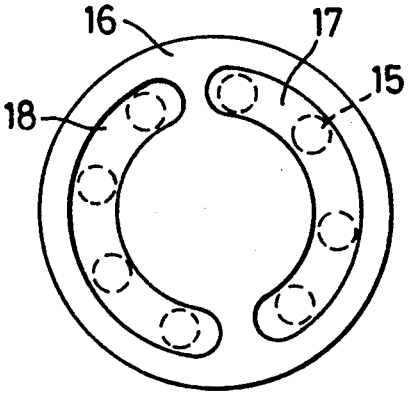
FIG. 10 is a partial sectional view on the line II—II of FIG. 9.

Referring first to FIG. 9, the pump 10 is a conventional swash pump and comprises a cylindrical block 11 on a drive shaft 12 carried on bearings 13 and 14 and driven by an AG electric induction motor 19. The block 11 has a plurality of cylinders 15, arranged in a ring around the axis of the block. The cylinders 15 are open at the left-hand face of the block, which bears against a face plate 16 with two semicircular kidney-shaped ports 17 and 18 (FIG. 10), over which the ends of the cylinders pass. Each cylinder 15 contains a respective piston 20, the right-hand end of which is connected to an associated bearing plate 21 by means of a universal joint 22. Each bearing plate 21 is held against a yoke or swash plate 23 by a hold-down ring 24 attached to the yoke 23.

The yoke 23 is mounted generally transverse to the axis of the block 11 (axis of shaft 12) but is normally tilted relative to that axis. Hence as the block 11 rotates, so the pistons 20 are moved back and forth in their cylinders 15. As the left-hand end of each cylinder 15 moves round over the inlet port 18, its piston 20 is moved rightwards, sucking in hydraulic fluid at low (supply) pressure Pi from port 18; then when the cylinder moves over to the outlet port 17 and moves around over that port, so its piston 20 is moved leftwards, expelling the hydraulic fluid from that piston into port 17 at high (output) pressure Ps.

The yoke 23 is mounted in a pair of pivots 25, one on each side of the drive shaft 12 of the block 11, so that its degree of tilt can be varied. The flow rate of hydraulic fluid is thus directly dependent on the angle of tilt, being zero when the yoke is perpendicular to the axis of the block 11. The yoke 23 is controlled by a yoke actuator mechanism 30 having a projection 31 against which a fixed spring 32 bears on one side, and a piston 33 on the other side. The piston 33 is carried in a cylinder 34, to which hydraulic fluid at a control pressure Pc is fed. The higher the value of Pc, the further to the right (as seen in FIG. 9) the piston 33 moves against the force of the spring 32, and the closer the angle of the yoke 23 becomes to zero. Thus increasing Pc reduces the flow rate.

The control pressure Pc is derived from the output pressure Ps by means of a pressure compensator valve 40. This comprises a cylinder 41 with a spool 42, with the output pressure Ps fed through an inlet 43 to one side and the supply pressure Pi fed through an inlet 44 to the other side. The position of the spool 42 is determined by the balance between the outlet pressure Ps and a spring 45, which bears against an extension 46 of the spool 42. An outlet 47 at the side of the spool 42 is fed with the supply pressure Pi or the output pressure Ps in dependence on the position of the spool 42, and this outlet is connected to the yoke actuator mechanism 30 to provide the control pressure Pc thereto. A screwthreaded pressure adjuster 48 sets the balance point of the valve 40.

If the pump output pressure Ps rises, for example, the compensator valve spool 42 moves downwards against the force of the spring 45, allowing the high pressure Ps from the pump output to pass from the inlet 43 to the outlet 47. This increases the control pressure Pc to the yoke actuating mechanism 30 which in turn decreases the angle of the yoke 23, so decreasing the flow rate. Provided that the load on the pump is not of exceptional character, the decreased flow rate will result in a reduction in the outlet pressure. The feed-back thus operates to hold the output pressure steady.

Figure 11:
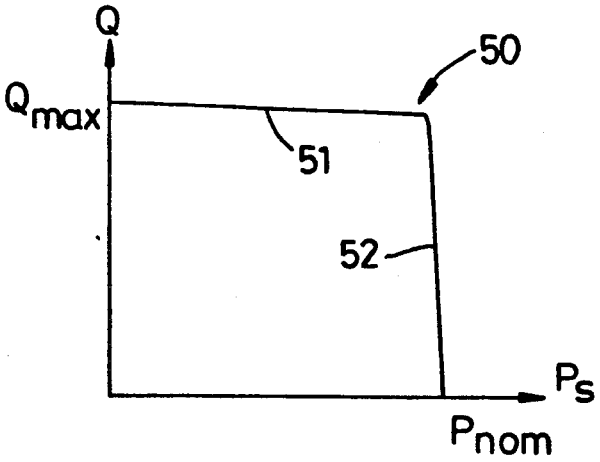
FIG. 11 is a flow-rate/pressure characteristic graph of the system of FIG. 9.

The pump 10 therefore has a flow rate (Q) against pressure (Ps) characteristic as shown by graph 50 of FIG. 11. The maximum flow rate Fmax is that which occurs when the yoke 23 is at its maximum angle, i.e. when the piston 33 is fully in the cylinder 34, and the curve therefore has a limb 51 where the flow rate is at this limiting value regardless of pressure. If, however, the flow rate is below Fmax, the pressure is held constant at the nominal output pressure Pnom regardless of the flow rate, as shown by limb 52. In practice, however, limb 51 has a slight deviation from the horizontal due to internal leakage of the pump, and limb 52 has a slight deviation from the vertical due to non-infinite control loop amplification. Such a slight deviation is desirable, to minimise instability.

It will be realised that in the constant pressure region of operation (limb 52), the torque required to drive the pump is proportional to the flow rate; the input power is the torque/speed product, and the output power is the pressure/flow-rate product. These are ideally equal, but differ in practice because of losses in the pump.

Figure 12:
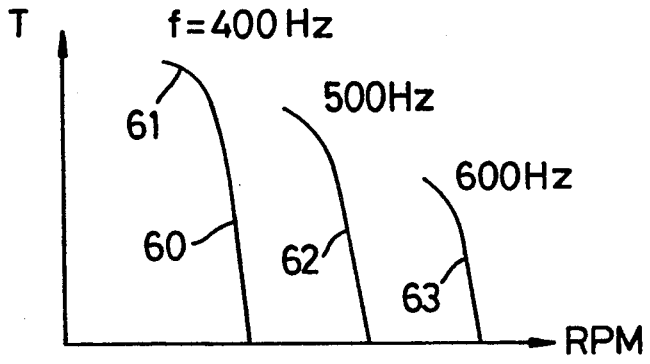
FIG. 12 is a set of torque/speed characteristic graphs for an AC electric induction motor for different frequencies.

The typical torque/speed characteristic of the induction motor 19 driving the pump at a constant frequency, is shown by curve 60 in FIG. 12. It will be seen that the speed (RPM) is approximately constant for a wide range of torques (T), but at the end of that range, it undergoes a relatively sharp transition or bend (at 61) where the speed falls substantially for a relatively small increase of torque. In this region the motor operation is unstable and tends to stall. Thus for any given motor there is a relatively well defined maximum torque.

The curve 60 is for a given AC frequency (f), which matches the motor speed. For different frequencies there is a family of curves 62, 63, etc. It will be noted that the bends of these curves lie at decreasing heights for increasing frequencies. The power output of the motor 19 is the torque/speed product, and the maximum power output for a given frequency is thus obtained at the bend of the appropriate curve (e.g. at 61 on the curve 60).

If the AC frequency varies, then the motor speed will vary accordingly. The pump feedback maintains the output pressure constant, so the output pressure will not be affected by the changing speed. However, the flow rate is proportional to the product of the speed and the yoke angle, and the maximum flow rate will therefore change in correspondence with the changing speed. As already explained, the maximum power output from the pump for a given frequency will be proportional to the frequency (since the maximum power is proportional to the maximum pressure/flow-rate product, and the pressure is constant while the maximum flow rate is proportional to the speed). The maximum power required from the motor 19 will be the same, and since the motor output power is the speed/torque product, the maximum motor torque required will be independent of the motor speed and the AC frequency. However, the maximum torque of an AC induction motor is inversely related to the motor speed or AC frequency i.e. motor torque at the maximum frequency must be equal to the maximum torque required by the pump. This is also the point of maximum power output.

In certain circumstances—that is, with certain types of load—it is possible to tolerate a lower maximum power from the pump at the higher frequencies. However, to avoid the danger of the motor stalling in critical environments such as for example, in an emergency hydraulic supply system for an aircraft, it is necessary to prevent the power output of the pump from exceeding the maximum power output of the motor at such higher frequencies. The motor can then be matched to the desired maximum power output at a median or low frequency, with the system giving the desired performance at meridian or low frequencies.

The maximum power output of the pump 10 must therefore be restricted in dependence on the AC frequency. Since the pump power output is, for a given frequency, proportional to the yoke angle, the maximum yoke angle must be reduced in dependence on frequency. For a low drive frequency, where the motor power is adequate for a full flow rate, the yoke angle can of course be allowed to vary over its full range. The yoke angle range-always, of course, extends from zero (zero flow rate). If the maximum yoke angle varies inversely with speed, the torque will also vary in the same way. This matches the motor characteristic so that the max pump output power will be close to the motor power regardless of frequency or speed. The maximum available flow from a pump controlled in this way is essentially constant i.e. independent of frequency and speed.

Figure 13:
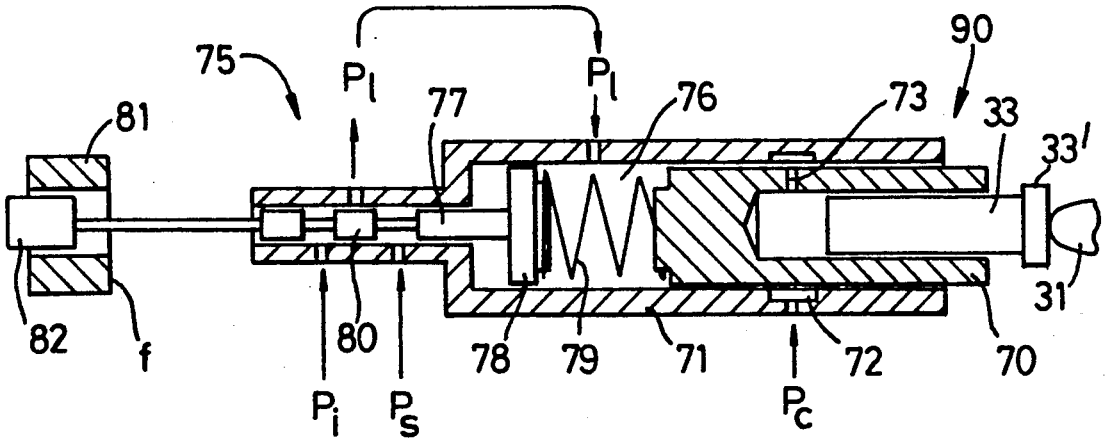
FIG. 13 is a simplified diagrammatic view, mainly in section, of adjustment means of a first embodiment of the present invention.

FIG. 13 shows the modification to the known system of FIG. 9 by which this objective is achieved in accordance with the present invention, this modification being way of the addition of adjustment means indicated generally at 90. The piston 33 of the yoke actuator mechanism 30 is slidably mounted in cylinder means in the form of a tube 70 which, instead of being fixed like the cylinder 34, is itself a piston in a fixed cylinder 71. As will be explained below, the position of the tube 70 is determined by the drive frequency. This piston 33 is driven by the control pressure Pc, as above, which reaches the piston via a ring channel 72 in the piston 71 and a passage 73 in the tube 70.

Figure 1:
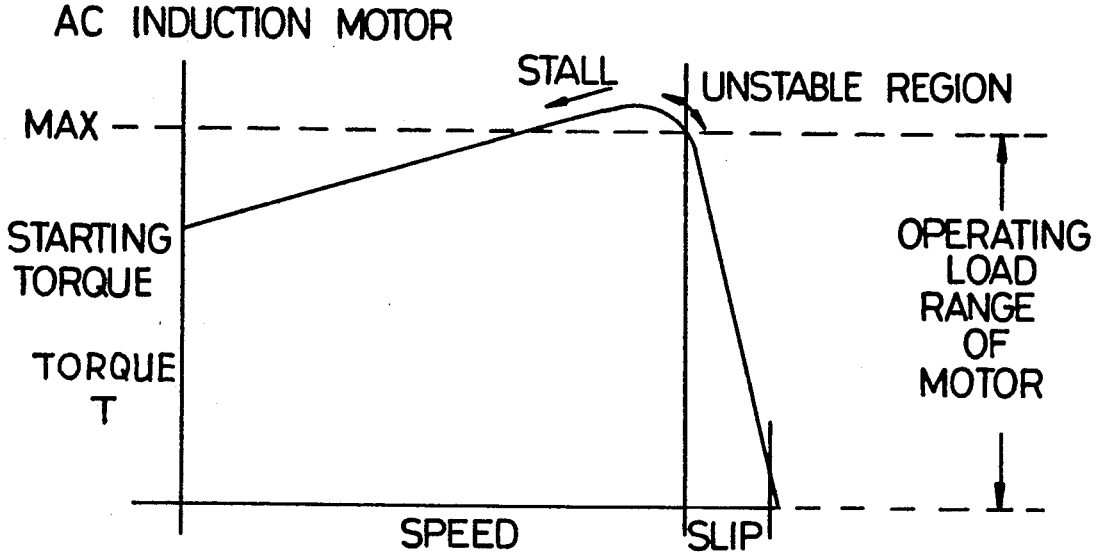
Figure 2:
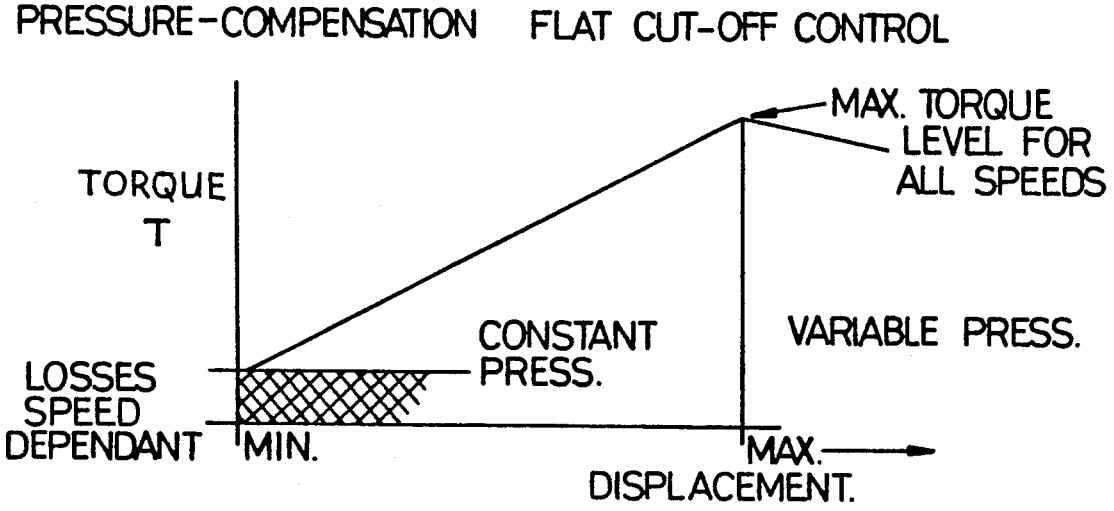
Figure 3:
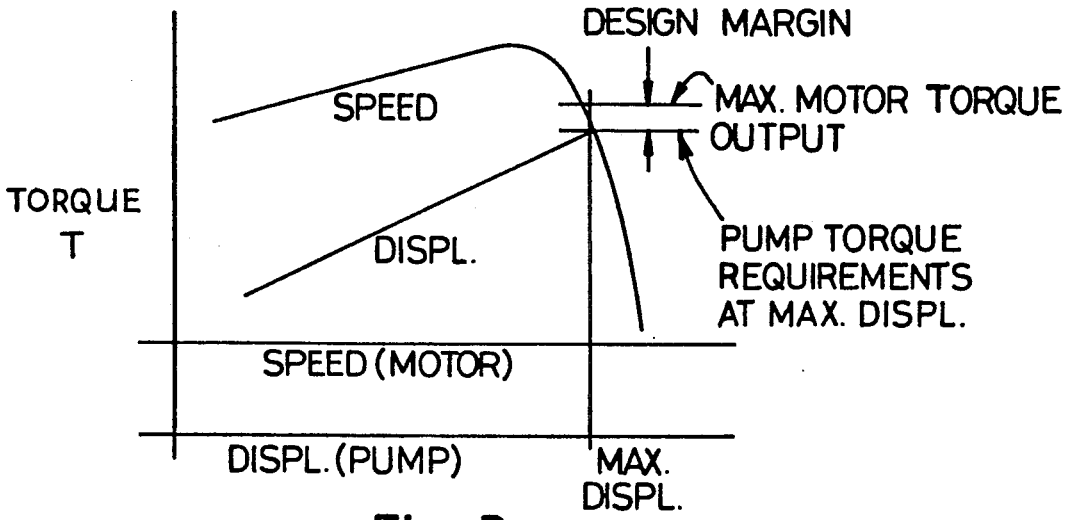
Figure 4:
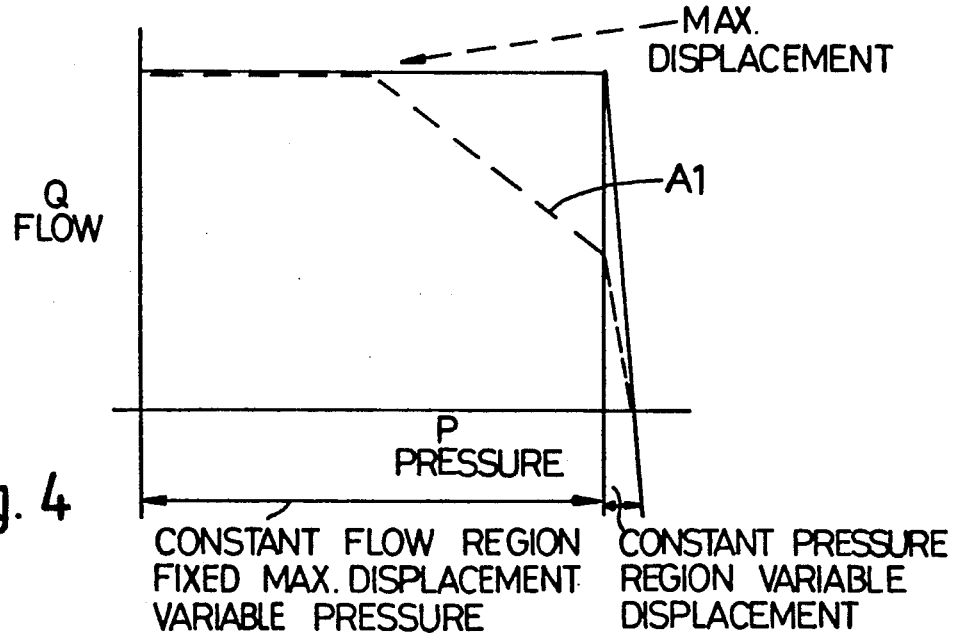
Figure 5:
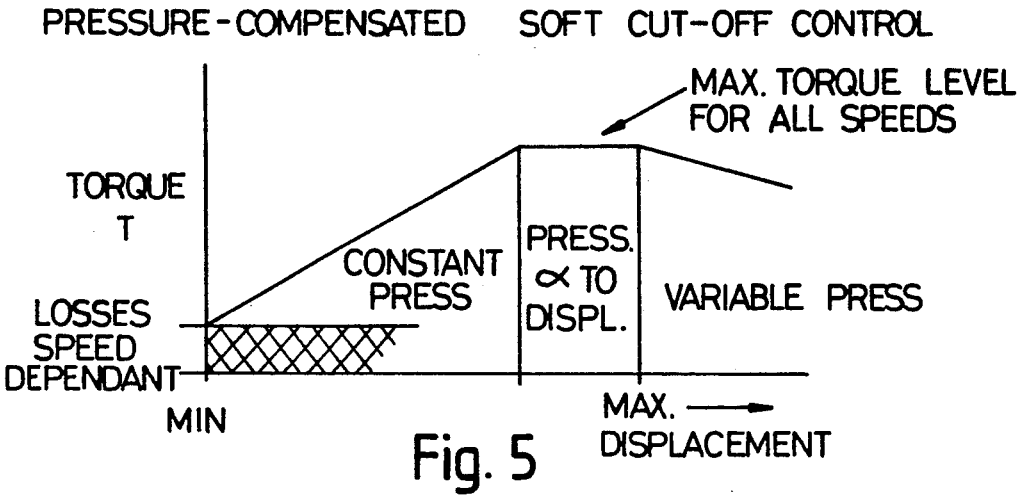
Figure 6:
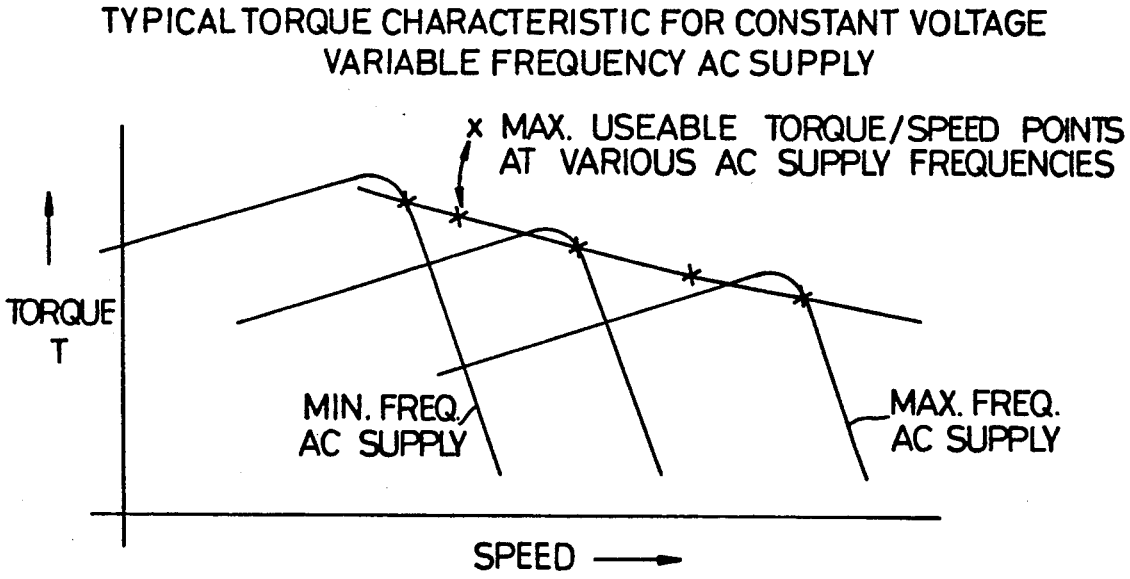
Figure 7:
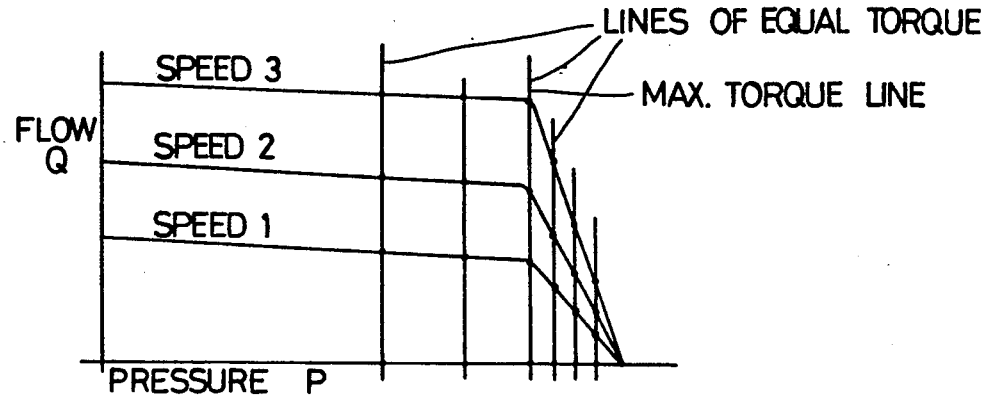
Figure 8:
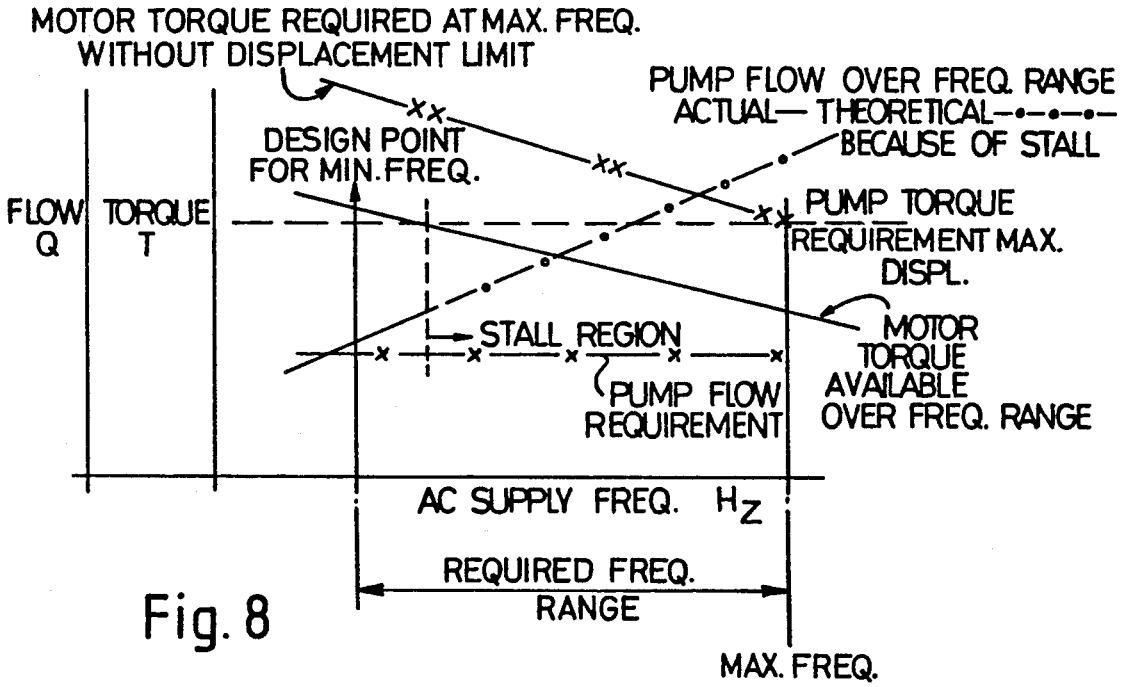

Provided that the outer end of the piston 33 is beyond the open end of the tube 70, the operation is as described with reference to FIG. 1; it is evident that the position of the piston 33 is not affected by the position of the tube 70. In particular, the extreme right most position of the piston 33 will, as above, hold the yoke 23 at right angles to the shaft 12, and give zero flow rate. However, the leftward travel of the piston 33 will be limited by the position of the tube 70; the further to the right the tube 70 is held, the less the leftward travel of the piston 33 will be, and the lower the maximum flow rate. Hence the more restricted the operating range of the pump 10. The outer end of the piston 33 is formed with a head 33' which is engageable with the open end of the tube 70 to limit its sliding movement within the tube 70, the extent of this sliding movement determining the operating range of the pump 10.

The position of the tube 70 is controlled by a limit control pressure P1 fed to the cavity 76 at its left-hand end. The pressure P1 is produced by a limit spool valve assembly 75 formed integrally at the left-hand end of the cylinder 71. As will be seen below, the right-hand end 78 of the spool 77 of the valve 75 may be taken as having an essentially fixed position. Hence the position of the tube 70 is determined by the combined effect of the limit control pressure P1 and a spring 79; if P1 is increased, the force on the left-hand end of the tube 70 is increased, and the tube moves rightwards until the increase of force due to the increased value of P1 is matched by the decrease of force from the spring 79.

The restoring leftwards force on the cylinder is supplied by the control pressure Pc acting on the left-hand end of the cylinder of tube 70. Since Pc is variable, the position of the tube 70 will vary somewhat even though the motor speed may be constant. However, at the point at which the travel of the piston 33 is limited by the tube 70, the pressure Pc will have a value dependent solely on the motor speed, so this movement of the tube 70 is irrelevant.

In the limit control valve 75, the limit control pressure P1 is derived from the supply pressure. Pi and the output pressure Ps. An enlargement 80 on the spool 77 has the output pressure Ps fed to one side and the supply pressure Pi fed to the other side as shown. The position of the spool 77 is determined by the balance between the outlet pressure P1 and the force exerted by a solenoid 81 on a core 82 which forms a leftward extension of the spool 77.

The solenoid 81 is energised with an AC drive current obtained from across the AC supply to the motor 19, and has the characteristic that the force it exerts on its core is inversely dependent on the frequency of the drive current, i.e. inherently the same operating characteristic as the motor 19. Thus, if the frequency increases, for example, the rightward force on the core 82 falls and the spool 77 therefore tends to move to the left. This moves the land 80 to the left, increasing the amount of the output pressure Ps (high) passing to the control limit pressure P1 and decreasing the amount of the supply pressure passing Pi (low) to P1. The limit control pressure P1 therefore rises, increasing the pressure in the chamber 76.

As discussed above, this causes the tube 70 to move to the right, so reducing the travel of the piston 33 and hence the maximum flow rate of the pump. The leftward force on the end 78 of the spool 77 increases by the same amount, so causing the spool 77 to move back leftwards. Thus the spool 77 is maintained in a balanced position, with changes in the force from the solenoid 81 being balanced by corresponding changes in the control limit pressure P1. As discussed above, it is this pressure Pi which determines the position of the tube 70 and hence limits the maximum flow rate of the pump. Thus the operating range of the pump is adjusted in dependence upon variations in the frequency of the AC supply and hence compensation effected therefor. By this simple, but highly effective, expedient any variation in frequency of the power supply input is used to advantage so that the displacement or operating range of the pump or secondary mover is adjusted according to that frequency, whereby the prime mover is allowed to operate at maximum torque at all times and does not have to be oversize as was previously the case.

Figure 14:
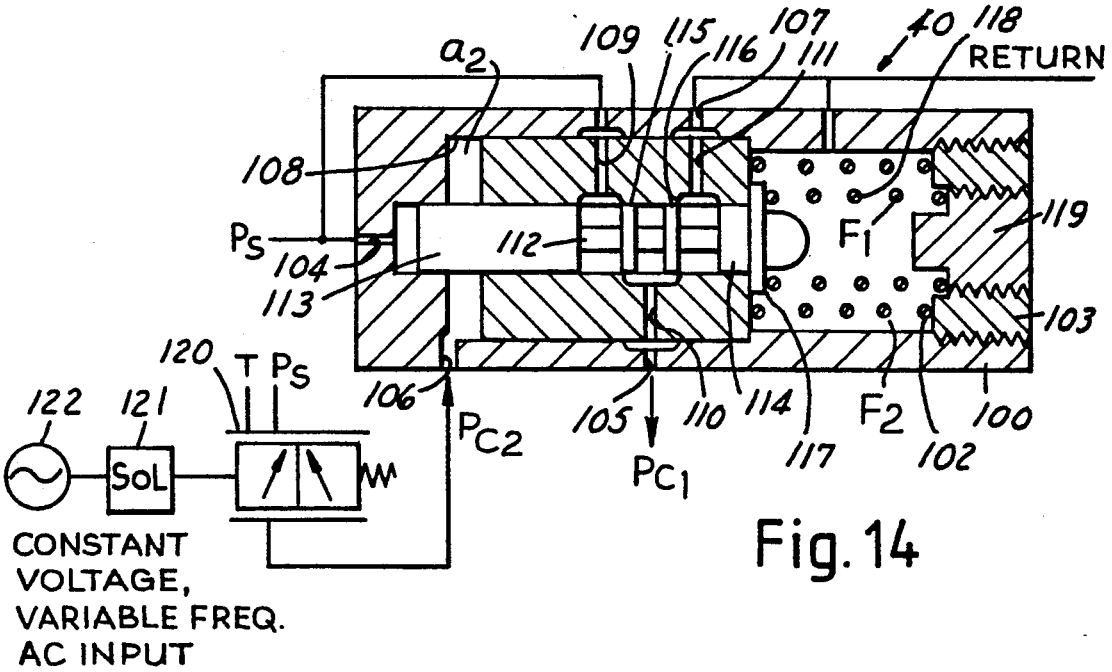
FIG. 14 is a diagrammatic representation of another embodiment of the present invention.

Referring now to FIG. 14, this relates to another embodiment of the present invention which is also based on the known arrangement of FIG. 9 but with the pressure compensator 40 being modified. In this embodiment, flow is maintained at the expense of pressure. The pressure compensator 40 comprises a casing 100 in which is slidably mounted a modulating sleeve 101 acting against a spring 102 of force $F_2$ disposed between one end of the sleeve and means 103 for setting the pre-load on the sleeve 101 and provided at the adjacent end of the casing. The casing 100 has a supply pressure ($P_S$) port 104, a control pressure output port ($P_{C1}$) and a control pressure input port ($P_{C2}$) ports 105 and 106 and a return or tank port 107. The ports 104, 106 and 107 communicate with a through bore 108 in the sleeve 101 via respective sleeve drillings 109, 110 and 111. The supply pressure $P_S$ (which is the outlet pressure of the pump 10) is also applied to one end of a spool 112 slidably mounted in the bore 108 of the sleeve 101, the spool having a land 113 at that end, a land 114 at the opposite end and two intermediate lands 115 and 116.

The land 114 is provided with a flange 117 engageable with a stop provided by the end of the sleeve 101 against which the spring . 102 acts, a further spring 118 of force $F_1$ acting between the flange 117 and adjustment means 119 for the pressure compensator. It will be appreciated that apart from the modulating sleeve 101, and related components, the pressure compensator is conventional.

The sleeve 101 and spool 112 are controlled by a two-position proportional solenoid valve 120 serving in the first, illustrated, position to provide the second pressure control signal $P_{C2}$ to the port 106, this signal being derived from the pressure supply signal $P_S$. In the other position of the valve, the port 106 is connected to tank. The solenoid 121 controlling the valve 120 is driven by a substantially constant voltage variable frequency AC supply 122, the frequency of which is directly related to the speed of the prime mover, because it is the same power supply driving the prime mover, whereby the second pressure Control signal $P_{C2}$ is proportional to the torque output of the prime mover. Decreasing frequency increases solenoid force and increases $P_{C2}$, while increasing frequency decreases solenoid force and decreases $P_{C2}$.

FIG. 14 shows the sleeve 101 and spool 112 in the maximum pressure setting position, i.e. in balance between the hydraulic pressures acting in one direction and the springs 102 and 118 acting in the other direction. Should the speed of the prime mover increase, as a result of increased AC supply frequency, the frequency of the drive signal to the solenoid 121 will increase, whereby the second control pressure signal $P_{C2}$ will decrease, this signal acting on the left-hand end of the sleeve 101 over the area indicated as $a_2$and thus moving the sleeve to the left. The spool 112 will follow the sleeve in this movement although there will inevitably be a time lag so that the output first control pressure signal $P_{C1}$ will temporarily be increased because the port 105 will be connected to the pressure port 104 until such time as the system pressure decays and sleeve 101 and spool 112 are in the same relative position as previously. At the completion of these movements of the sleeve 101 and spool 112, the respective springs 102 and 118 are less compressed than previously, whereby the pressure setting of the device changes, as it does when the sleeve moves to the right on a decrease in the AC supply frequency to the prime mover. Thus it will be seen that the pressure is modulated in accordance with the frequency of the AC supply to the prime mover, and therefore the available torque, this signal being applied to the yoke actuator mechanism 30 to increase or decrease the stroke of the pump, as appropriate, to the pump outlet pressure.

Figure 15:
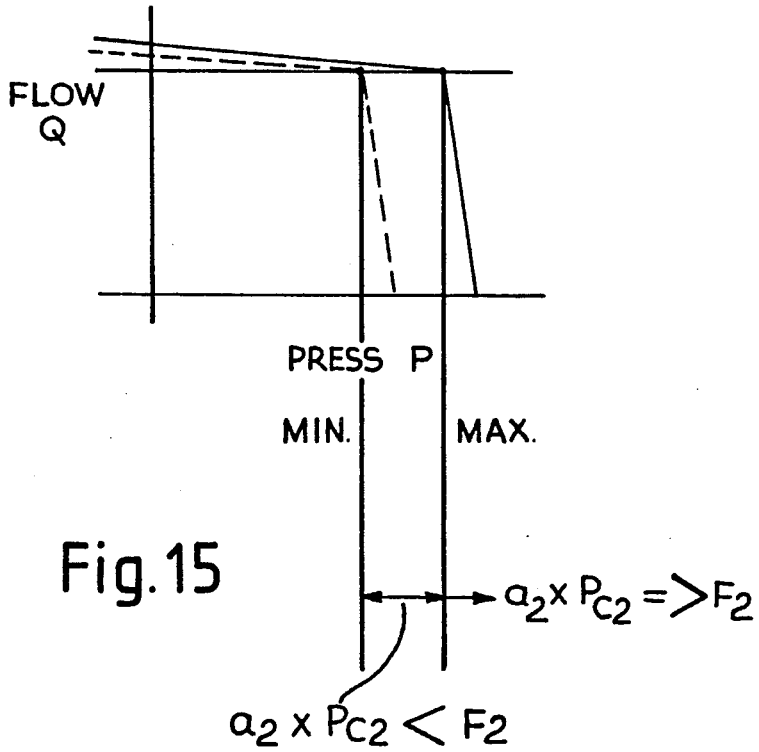
FIG. 15 is a graph useful in explaining the operation of the embodiment of FIG. 14.

FIG. 15 is a graph showing the operating characteristics of the embodiment of FIG. 14.

Figure 16:
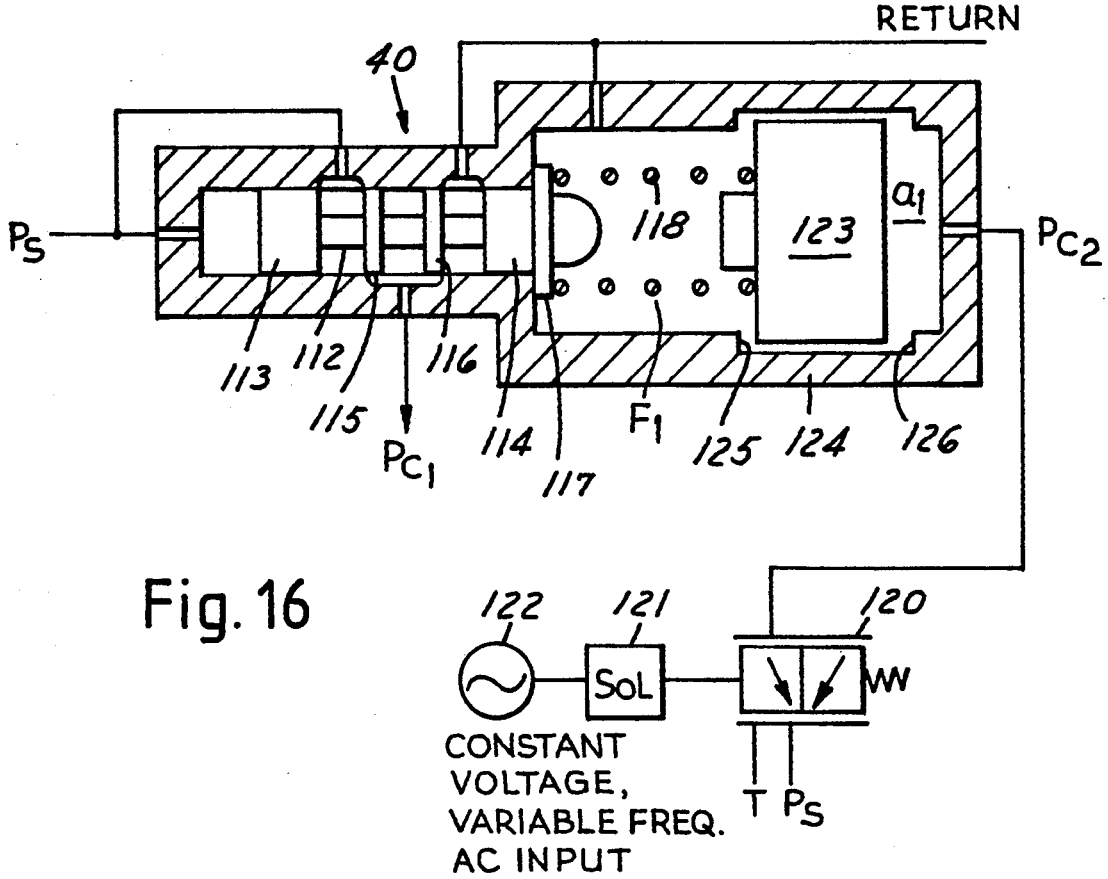
FIG. 16 is a diagrammatic representation of a further embodiment of the present invention.

Turning now to FIG. 16, this shows an alternative modification to the conventional pressure compensator 40 of FIG. 9, compared to that of FIG. 14, and it will be seen that in this arrangement, the modulating sleeve 101 of the embodiment of FIG. 14 is replaced by a modulating piston 123 slidably mounted in a casing 124 between maximum and minimum pressure stops 125 and 126. The conventional pressure compensator again comprises a spool 112 having a similar configuration to that of FIG. 14, whereby like reference numerals are employed. The spool-is acted upon between the spring 118 disposed between the spool flange 117 and one end of the modulating piston 123, the other end of which of area $a_1$ is acted upon by the second control pressure $P_{C2}$ provided by the proportional solenoid valve 120 which is similar to that of FIG. 14 and the solenoid 121 of which receives a substantially constant voltage, variable frequency, AC drive signal, the frequency of which is proportional to the speed of the prime mover. Thus, the output control signal $P_{C1}$ from the compensator is again modulated accordance with the frequency of the AC supply to the prime mover, and therefore the available torque, so as to increase or decrease the stroke of the pump accordingly. In this embodiment flow is again maintained at the expense of pressure.

Figure 17:
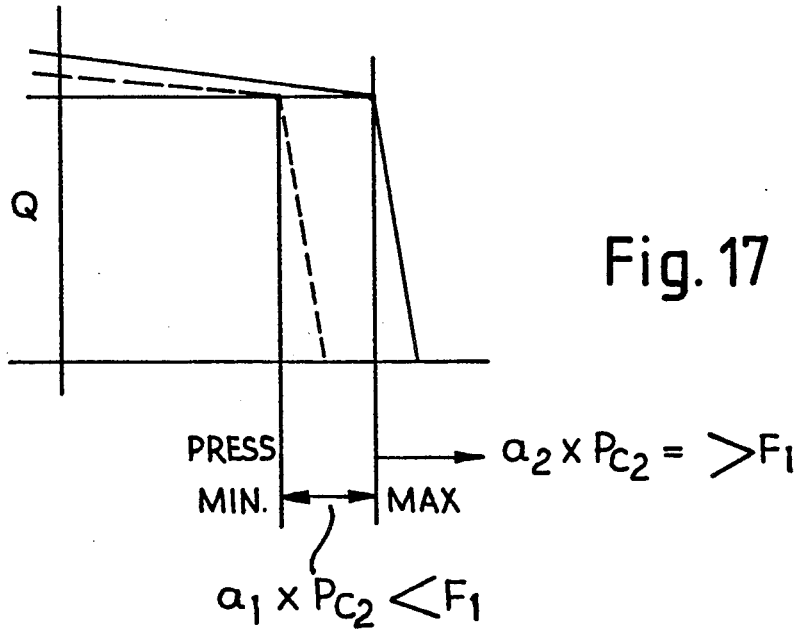
FIG. 17 is a graph useful in explaining the operation of the embodiment of FIG. 16, and FIGS. 18, 19 and 20 are diagrammatic representations of a still further embodiment of the present invention.

FIG. 17 is a graph showing the operating characteristics of the embodiment of FIG. 16.

In the embodiments of FIGS. 14 and 16, the solenoid 121 could be arranged to act directly on the sleeve 101 or piston 123.

Figure 18:
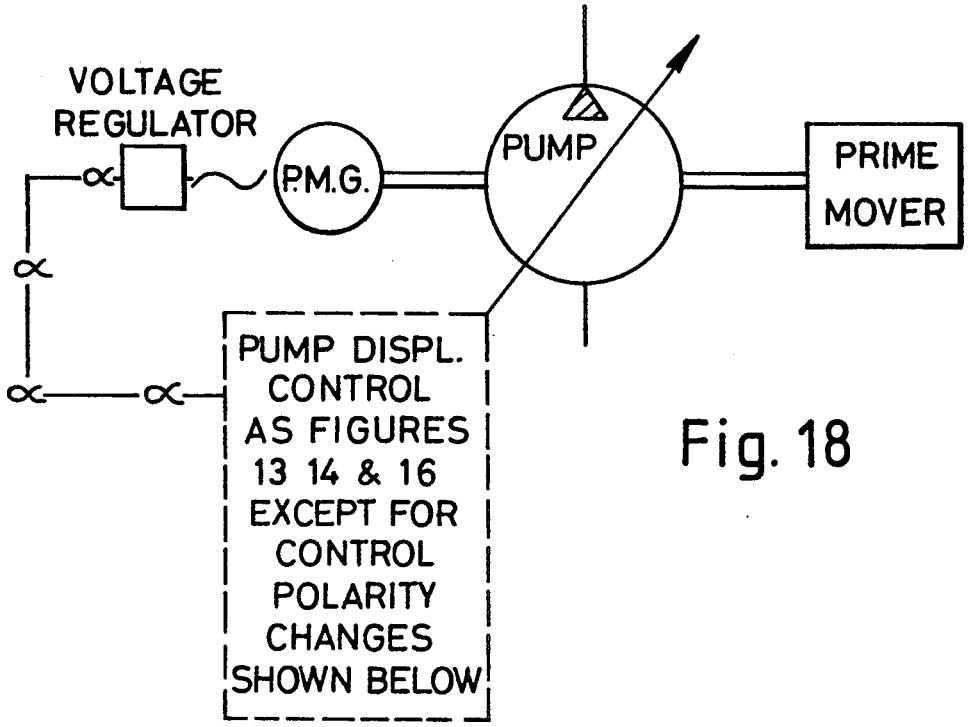
Figure 19:
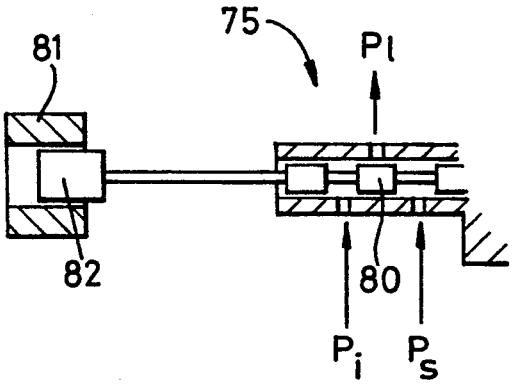
Figure 20:
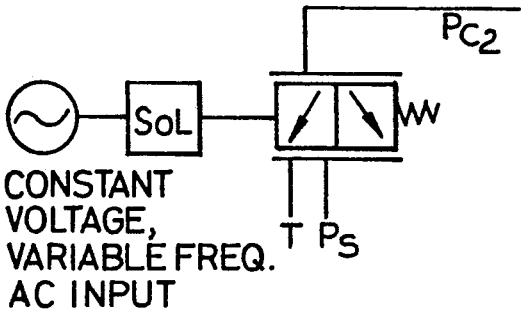

Turning now to FIG. 18, this illustrates a still further embodiment of the present invention in which a pump 30 is driven by a prime mover 131 which is other than a prime mover energised by an AC power supply and may be, for example, a ram air turbine. Connected to the pump 130 is a permanent magnet generator (PMG) 132 which generates a variable frequency AC output supply signal substantially regulated to constant voltage, on a line 133, this signal varying in accordance with the speed of the pump 130, and hence in accordance with a speed of the prime mover 131. The output signal from the PMG 132 is applied to the solenoid 81, 82, and 121 of the pump displacement control mechanisms substantially as illustrated and described in connection with FIGS. 13, 14 and 16 of the drawings but modified for polarity as shown in FIGS. 19 and 20. For example, referring to FIGS. 14 and 20, sleeve 101 is shown in the maximum pressure setting position which would equate to the maximum speed of the prime mover or the maximum speed at which pressure control is needed. Spool 112 is shown in the null position, i.e. in a stable pressure regime. Should the speed of the prime mover reduce, as a result of lower available output power or increased pump load, the frequency of the PMG output will reduce and the signal to the solenoid 121 will give higher force and decrease the pressure signal $P_{C2}$ by moving the spool of value 120 to the right against the bias spring. The decrease in pressure over area $a_2$ allows the spool 101 to move to the left under the action of spring 102. This will temporarily change the relative position of sleeve 101 and spool 112 and increase control pressure $P_{C1}$ by opening port 105 to the $P_S$ port 104 causing the pump to destroke. When the system pressure $P_S$ falls to the new lower setting; spool 112 will again return to the null position with respect to sleeve 101. If pump load reduces or prime mover output power increases giving rise to an increase in speed the reverse will occur resulting in an increase in the pump displacement, matching the pump demanded power to that available from the prime mover and hence preventing the stalling of the prime mover.

As regards FIG. 19, the control is as for FIG. 13 except decreasing frequency causes the core 82 to move to the left, and increasing frequency causes the core to move to the right. Thus, it will be seen that this embodiment of the invention enables a pump to be controlled according to the speed of a prime mover even when the latter is not driven by an AC power supply. An electromagnetic device other than a PMG may be employed.

It will be appreciated that in the embodiments of FIGS. 13, 14, 16 and 18 any variable displacement pump may be employed such as, for example, a variable vane pump or radial piston pump.

It will be seen that the present invention can be applied to a number of different circumstances. For example, it can be used to adjust the torque to a secondary mover when the prime mover and adjustment means are driven by the same constant voltage, variable frequency AC supply (CVVF) or to adjust the stroke or pressure output of a pump which forms the secondary mover in the same circumstance, i.e. the adjustment means and prime mover are driven by the same CVVF supply. In the case where the prime mover is not driven by a CVVF supply, then the adjustment means is driven by such a supply derived from the prime mover, for example by a PMG, and the adjustment means can again be used to adjust the power to the secondary mover or adjust the stroke or pressure when the secondary mover is in the form of a pump.

As is well known, polyphase motors are widely employed and the use of such, or even a single-phase motor, is acceptable with the present invention because any change in the frequency of the supply will affect each phase substantially in the same way and even if the adjustment means use only one phase of a polyphase supply, it will then see the same variation in frequency.

It will be apparent from the foregoing, that the present invention affords a significant advance in the art in that it enables an electromagnetic control means to be driven by an AC signal, the frequency of which is proportional to the speed of a prime mover which drives a secondary mover.

I claim:

1. An open-loop hydraulic supply system comprising a variable displacement swash pump driven by an electric motor in use powered by an alternating current (AC) electrical supply, whereby the operation of the pump is affected by any frequency variation in the AC supply, characterised in that the system further comprises adjustment means in use powered by the same AC supply as the motor, having an inherently substantially similar operating characteristic as the motor, and being coupled to the pump and operable to adjust the operating range thereof in accordance with variations in the frequency of the AC supply, the adjustment means comprising first cylinder means in which the piston of the yoke actuator of the swash pump is mounted for limited sliding movement, the extent of which movement determines the operating range of the pump, the first cylinder means being slidably mounted, in the manner of a piston, in a second and fixed cylinder of the adjustment means, and electromagnetic drive means coupled to the first cylinder means is positioned within the second cylinder means in accordance with any variation in the frequency of the AC supply so as to vary the range of operation of the pump.

2. A system according to claim 1, wherein the inherently substantially similar operating characteristic is that of the torque or force output of the adjustment means and the motor is similarly entirely proportional to the AC supply frequency.

3. A system according to claim 1, wherein the adjustment means comprises electromagnetic means energized, in use, by said AC supply.

4. A system according to claim 3, wherein the electromagnetic means comprises a solenoid.

5. A system according to claim 3, wherein the electromagnetic means comprises a force motor.

6. A system according to claim 3, wherein the electromagnetic means comprises an electric motor.

7. A system according to claim 1, wherein the piston is provided with a collar which is engageable with the open end of the first cylinder means to limit said sliding movement.

8. A system according to claim 1, wherein the flow of hydraulic fluid is to be maintained substantially constant, the apparatus further comprising hydraulically-operated modulation means controlled by the adjustment means.

9. A system according to claim 8, wherein the modulation means comprises a sleeve in which is slidably mounted a spool, the sleeve and spool acting against spring means.

10. A system according to claim 8, wherein the modulation means comprises a piston generally coaxially mounted with a spool valve with spring means acting therebetween.

11. A system according to claim 1, wherein the adjustment means (90) is operable to adjust the torque of the secondary mover.

12. A system according to claim 1, wherein the adjustment means is operable to adjust the stroke or pressure of the swash pump.

13. An open-loop hydraulic system system for controlling the range of operation of a secondary hydraulic mover driven by an electric prime mover powered, in use, by substantially constant voltage alternating current variable frequency (AC) electrical supply, whereby the operation of the secondary mover is affected by any frequency variation in the AC supply, characterised in that the system further comprises AC electric adjustment means (90) on the secondary mover, the movement of which determines the operation range of the secondary mover in use powered by the same AC supply as the prime mover, having an inherently substantially similar operating characteristic as the prime mover, and being coupled to the secondary mover and operable to adjust the operating range of the secondary mover in accordance with variations in the frequency of the AC supply so as to vary the operation of the secondary mover.

14. Apparatus according to claim 13, wherein the prime mover is a ram air turbine.

15. An open-loop hydraulic supply system comprising a variable displacement pump driven by an electric motor in use powered by an alternating current (AC) electrical supply, whereby the operation of the pump is affected by any frequency variation in the AC supply, characterised in that the system further comprises adjustment means on the pump, the movement of which determines the operating range of the pump in use powered by the same AC supply as the motor, having an inherently substantially similar operating characteristic as the motor, and being coupled to the pump and operable to adjust the operating range of the pump in accordance with variations in the frequency of the AC supply so as to vary the range of operation of the pump.

16. A system according to any one of claim 13 and 15 wherein the adjustment means comprises electromagnetic means in the form of a solenoid.

17. A system according to any one of claim 7 and 8 wherein the adjustment means comprises electromagnetic means in the form of a force motor.

18. A system according to any one of claims 13 and 15 wherein the adjustment means comprises electromagnetic means in the form of an electric motor.

19. Apparatus according to any one of claim 13 or 15, wherein the adjustment means is powered by a permanent magnet.

20. A system according to any one of claims 7 or 8, characterised in that the inherently substantially similar operating characteristic is that of the torque or force output of the adjustment means and the prime mover or motor being similarly entirely proportional to the AC supply frequency.

21. A system according to any one of claims 13 or 15, characterised in that the adjustment means comprises electromagnetic means energised, in use, by said AC supply.

22. A system according to any one of claims 13 or 15, wherein the adjustment means comprises electromagnetic means in the form of a solenoid.

23. A system according to any one of claims 13 or 8, wherein the adjustment means comprises magnetic means in the form of a force motor.

24. A system according to any one of claims 13 or 24, wherein the adjustment means comprises electromagnetic means in the form of an electric motor.

* * * * *